United States Patent [19]

Scott

[11] 4,216,026

[45] Aug. 5, 1980

[54] SYSTEM FOR REMOVING FLUID AND DEBRIS FROM PIPELINES

[75] Inventor: Paul R. Scott, Houston, Tex.

[73] Assignee: Shell Oil Company, Houston, Tex.

[21] Appl. No.: 8,990

[22] Filed: Feb. 5, 1979

[51] Int. Cl.[3] ..... B08B 9/04

[52] U.S. Cl. ..... 134/4; 134/8; 134/22 C; 134/34

[58] Field of Search ..... 134/4, 6, 8, 22 C, 34, 134/42; 15/104.06 R; 106/205, 209; 252/28; 137/15

[56] References Cited

U.S. PATENT DOCUMENTS

| | | | |
|---|---|---|---|
| 2,941,537 | 6/1960 | Watkins | 15/104.06 R X |
| 3,096,293 | 7/1963 | Jeanes et al. | 106/209 X |
| 3,209,771 | 10/1965 | Gogarty et al. | 137/1 |
| 3,342,732 | 9/1967 | Goetz | 106/205 X |
| 3,523,826 | 8/1970 | Lissant | 134/22 C |
| 3,729,460 | 4/1973 | Patton | 106/205 X |
| 3,734,801 | 5/1973 | Sebel | 106/205 X |
| 3,762,950 | 10/1973 | Royka | 134/6 |
| 3,812,937 | 5/1974 | Abbott et al. | 252/28 X |
| 3,821,008 | 6/1974 | Jordan et al. | 106/209 |
| 3,871,826 | 3/1975 | Bakay | 134/22 C X |
| 3,951,850 | 4/1976 | Clocker et al. | 252/28 X |
| 4,003,393 | 1/1977 | Jaggard et al. | 134/22 C X |
| 4,105,578 | 8/1978 | Finlayson et al. | 252/28 X |

OTHER PUBLICATIONS

Bird et al., *Transport Phenomena,* 1966, pp. 10–11.

*Primary Examiner*—Marc L. Caroff

[57] ABSTRACT

To remove fluid and/or particulate debris from a pipeline, a Bingham plastic fluid plug is passed through a pipeline and the fluid and/or debris are collected by the plug. The plug is pushed through the pipeline with a scraper which in turn may be pushed by liquid or gas pressure. Where the fluid to be removed is water, the Bingham plastic fluid plug employed preferably is a composition of water and a xanthan gum, and the gum may be cross-linked with a multivalent metal. Where the fluid to be removed is a hydrocarbon, the Bingham plastic fluid plug employed preferably is a composition of a mineral oil and an organo-modified smectite, and may also include a particulate filler such as powdered coal.

21 Claims, 4 Drawing Figures

PLASTIC SLUG COMPOSITION:

| | SOLIDS | | OIL | | WATER | |
|---|---|---|---|---|---|---|
| | %w | %v | %w | %v | %w | %v |
| ORIGINAL | 42 | 33 | 56 | 64 | 2 | 3 |
| DISCHARGE | 61 | 46 | 19 | 27 | 20 | 27 |

SYSTEM FOR REMOVING FLUID AND DEBRIS FROM PIPELINES

BACKGROUND OF THE INVENTION

Pipelines are used to transport throughout the nation, a multitude of gas, liquid, and solid materials vital to the domestic and industrial well-being of the economy. Sand, weld slag, water, and other materials are left in a pipeline after the completion of a construction phase which normally consists of welding 20 to 40-foot long sections of steel pipe together to form a pipeline many miles long. During use sand, water, rust, and other debris may collect in a pipeline.

There is a need to remove this debris from the pipeline to effect safe and economic operations. Several methods are currently used to remove debris from pipelines. These include the use of scrapers, high velocity liquid flow and gel plugs. All of these have shortcomings, especially for very long pipelines. The pump capacity and/or volume of fluid needed to remove debris utilizing high velocity flow are often not available. Mechanical scrapers tend to either concentrate the debris in the pipeline to the point of plugging or bypass the debris leaving it in thick beds along the bottom of the pipe. Gels currently used either act much like the mechanical scraper, pushing the debris along the bottom of the pipe, concentrating it and bypassing the thick beds, or like other fluids, require very high velocity to create turbulence in the form of secondary flow currents sufficiently strong to pick up and suspend the debris.

The present invention provides a unique solution to the removal of loose and loosely adhering rust, silt, sand, weld slag, and other debris from pipelines. It is especially applicable both to long pipelines and short pipelines which contain a large quantity of debris distributed throughout.

REFERENCE TO PERTINENT ART AND RELATED APPLICATIONS

The following U.S. Pat. Nos. are considered pertinent to the present invention: 4,040,974; 3,705,107; 4,052,862; 1,839,322; 3,425,453; 3,656,310; 3,751,932; 3,788,084; 3,842,612; 3,961,493; 3,978,892; 3,472,035; 3,777,499; 3,525,226; 3,890,693; 2,603,226; 3,523,826; 4,003,393; 3,833,010; 3,209,771; 3,272,650; 3,866,683; 3,871,826; 3,900,338; 4,064,318 and 4,076,628.

The following U.S. patent applications are considered relevant to the present invention: Ser. No. 823,810 filed Aug. 11, 1977, now abandoned; Ser. No. 932,395 filed Aug. 9, 1978; Ser. No. 836,876 filed Sept. 26, 1977, now abandoned and Ser. No. 943,012 filed Sept. 18, 1978, now abandoned.

SUMMARY OF THE INVENTION

The primary purpose of the present invention is to remove fluid and/or particulate debris from a pipeline. This is accomplished by inserting a plastic fluid plug into the pipeline, moving the plug through the pipeline by a rolling or a circulating motion generating a closed toroid, the wall of the toroid adjacent the wall of the pipeline remaining relatively essentially stationary and the center portion moving in the flow direction, and collecting the fluid and/or particulate debris with the plug.

More specifically, the present invention provides a method for removing fluid and/or particulate debris from a pipeline by passing a Bingham plastic fluid plug through the pipeline and collecting the fluid and/or particulate debris with the plug.

Preferably, a scraper is employed to push the plug through the pipeline, and the scraper in turn is pushed by a gas or liquid.

In addition, the present invention includes certain preferred compositions for the Bingham plastic fluid plug: (1) A composition of a mineral oil and an organo-modified smectite, optionally including a particulate filler such as powdered coal; (2) a composition of water and a xanthan gum; (3) the composition of (2) wherein the xanthan gum has been cross-linked with a multivalent metal. Generally, the plug is a flowable, non-thixotropic plastic composition having less moving shear stress at the wall of the pipeline than strength of adhesive bonding to the wall of the pipeline, to facilitate plug flow as above described.

DESCRIPTION OF PREFERRED EMBODIMENTS

The Bingham plastic fluid of the present invention is designed so that (1) it has the desired plastic viscosity-yield strength relationship and quantity, (2) it can be pumped at a wide range of velocities, (3) it will engage and pick up loose and loosely adhering solids, (4) it will distribute the engaged solids throughout the length of the fluid slug, and (5) it can be pumped for many miles without losing the ability to incorporate and carry solids. The requirements of a movable plug of the present invention are unique and differ from requirements for such things as drilling fluids, mudpacks, product separators, and line scrapers which, in fact, are not comparable to the present invention. The movable gel plug is a plastic fluid having a high yield strength, high viscosity, and low gel strength. The yield strength is independent of shear stress, shear rate, total work input, and time. Plastic fluids were defined by Bingham as fluids having a yield strength that must be exceeded in order to initiate flow. More importantly for the movable plug of the present invention, the flow stops when the force applied is less than the force required to overcome the yield strength.

Plastics exhibiting thixotropic properties (e.g. their flow properties may be time-dependent) are undesirable for use with the present invention. When a thixotropic fluid is allowed to stand quiescent, a gel structure is built up. When stress is applied, the gel structure breaks when the gel strength is exceeded. Movement further reduces the gel structure and decreases the flow resistance. A thixotropic plastic, at low pressures, usually flows as a plug lubricated by a thin film of highly sheared liquid at the pipe wall when the applied force is greater than the resistance force due to the yield strength. Accordingly, a non-thixotropic Bingham plastic is the best type of fluid for the movable gel plug, and it is preferable that the fluid plastic plug of the present invention at least behave as a Bingham plastic or shear thinning Bingham plastic.

Figure 1:
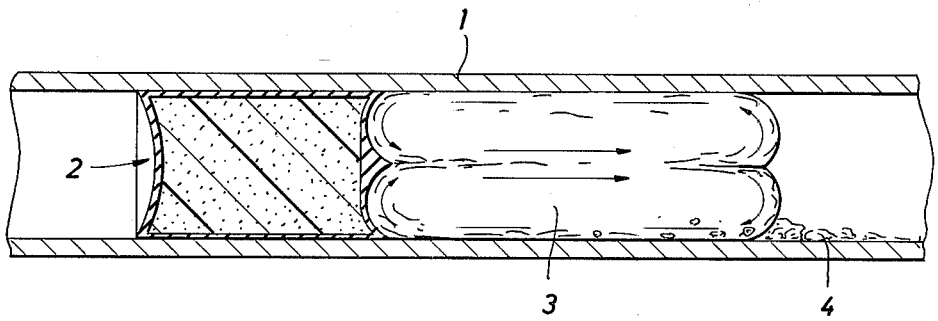
FIG. 1 shows the circulating motion of the Bingham plastic plug of the present invention while passing through a pipeline and collecting fluid and/or particulate debris.

As shown in FIG. 1, within a pipeline 1 is located a scraper 2 following a plastic fluid plug 3. Scraper 2 is forced by pressure of a gas or liquid (not shown) to force plug 3 forward (left to right as shown) in pipeline 1 to pick up debris and/or fluid 4. As shown by the arrows in FIG. 1, flow of plug 3 follows a special manner. The fluid in the center portion of plug 3 flows forward (left to right as shown) with little exchange of material with the fluid making up the annular flow region which is adjacent to the pipe wall and encases the center portion. The fluid of the plug 3 circulates or rolls in a motion essentially generating a closed toroid, of generally eliptical cross-section, the wall of the toroid adjacent the wall of pipeline 1 remaining relatively essentially stationary to the direction of motion of plug 3 in pipeline 1. As plug 3 moves through pipeline 1, scraper 2 removes the fluid forming plug 3 which is in the annular flow region adjacent to and in front of the scraper and forces it to move into the center portion of pipeline 1 and plug 3. Sand, rust, weld slag, other debris, and fluids compatible with plug 3 are entrained by the plastic fluid forming plug 3 in the vicinity of the wall of pipeline 1, moved into the center portion of plug 3, and carried down the length of plug 3. This mechanism results in distributing debris 4 throughout the length of plug 3 and continues until the plug is saturated, e.g., until the solids content of plug 3 is about 25% v. Both the yield strength and plastic viscosity of the plastic fluid increase as the solids content of the fluid increases. Thus, the original yield, viscosity, and quantity of the fluid making up the slug are designed for each use occasion.

The ability of a plastic fluid to entrain and keep in suspension solids removed from or near pipe walls is in part dependent upon the yield strength of the fluid. An entrained particle will not settle if the yield strength of the fluid is greater than the gravitational force on the settling particle. The quantity of fluid in the plug flow region depends upon the yield strength, plastic viscosity, and flow velocity of the fluid. Generally, a low viscosity and high yield strength fluid flows with a thin annular flow region while a high viscosity and low yield strength results in a thick annular flow region. The plastic fluid of the present invention used for cleaning a pipeline has a high yield strength and high viscosity and a low gel strength. The yield strength is essentially independent of shear stress, shear rate, total work input, and time.

The adhesive bond between the plastic fluid of the present invention and pipe wall must require more force to break than the force required to overcome the yield strength. Otherwise, the fluid would flow like a scraper fluid and suitable plug flow, i.e., center flow, would not occur. Yield strength of a plastic fluid is the shear stress at the pipe wall at which flow occurs, it being necessary to exceed a certain shear stress before flow occurs.

The primary constituents of the mineral oil base plastic fluids of the present invention (useful when it is desired to collect a hydrocarbon fluid and/or solids from a pipeline) are mineral oil, smectite, and optionally a filler. Fluid properties may be adjusted within limits by the appropriate concentration and type of these contstituents. The primary constituents of the water base plastic fluids of the present invention (useful when it is desired to collect water and/or solids from a pipeline) are water, a water-soluble polymer and optionally a filler. Xanthan gum, crosslinked with a multivalent metal, is a preferred water-soluble polymer but other water-soluble polymers such as guar gum, carboxymethylcellulose and polyacrylamide are suitable. Particulates, e.g. bentonite clay, may optionally be incorporated into the water base Bingham plastic.

Considering the above requirements for the mineral oil base plastic fluids useful with the subject invention, it has been found that suitable mineral oils are mainly hydrocarbons derived from organic matter such as, for example, petroleum. More specifically, preferred mineral oils are residual oils from thermal cracking processes. Oils that are suitable include an olefin plant oil which contains some aromatics and is derived by cracking butane, naptha, and/or gas oils to make ethylene, and a vacuum flashed residue of thermally cracked straight run pitch which contains aromatics and high-molecular weight compounds such as asphaltenes, nitrogen bases and oxygen compounds, and blends of these two oils. Typical properties of oils blended to be incorporated in plastic fluids are shown in Table 1.

In further compliance with the above-described requirements, the smectite of the composition is an organo-modified montmorillonite clay such as tetraalkyl ammonium smectite. VG69 manufactured by Magcobar Oil Field Product Division of Dresser Industries is an example of a smectite usable for plastic fluid formulations. Such a clay has a high gelling efficiency over a wide range of intermediate and low polarity organic liquids including various hydrocarbon oils and solvents. It has reproducible yield strength and consistency over a wide temperature range and imparts particle suspension, preventing settling of solids. It is undesirable to use a thixotropic gel since the yield strength of thixotropic gels decreases after flow starts, allowing solids collected by the gel to fall out; i.e., fail to remain suspended.

Also used with the mineral oil and the smectite are fillers such as coal dust, powdered calcium carbonate, and powdered gypsum or the like. Typical properties of smectite and one filler are shown in Table 2.

Components selected as the best readily available materials for formulating plastic fluids for cleaning pipelines are:

1. Shell Oil Company Deer Park Manufacturing Complex (DPMC) Dubbs No. 9 Flashed Residue
2. Shell Oil Company (DPMC) Olefin Plant No. 2 Residual Light Gas Oil (also sold as APO-100)
3. Alabama Low Sulphur Coal (ground to pass U.S. 100 mesh sieve)
4. Magcobar VG69 (organo-modified montmorillonite clay).

Similar materials useful with the invention are readily available world wide.

Based on the complete mixed composition, the mineral oil comprises from about 20 to about 95 weight percent, the smectite from about 5 to 30 weight percent, and the filler up to about 40 weight percent.

The variation in rheological properties obtainable by varying the above mineral oil base plastic fluids are shown in FIG. 1. Test data are shown in Table 3. Blend No. 9 is different from the other fluids tested, in this series, in that it contains no solid filler other than Magcobar VG69. This fluid represents one of a wide variety of fluids that can be made using oils and organo-modified clays. The viscosity of the fluid is controlled by controlling the oil viscosity and the yield strength is controlled by controlling the quantity of gelling organo-modified clay. Existing laboratory and field equipment can be used to compound all of these fluids.

Considering the requirements for the water base plastic fluid for cleaning pipelines, it has been found that clean, fresh water is preferred, although usable fluids can be made using brackish and sea waters. A preferred water soluble polymer which satisfies the requirement for water base plastic fluids is the high-molecular weight, linear natural polysaccharide produced by the micro-organism Xanthomonas Campestris, otherwise known as a xanthan gum. This product is sold by the Kelco Division of Merck and Company, Incorporated as KELZAN XC® Polymer hereinafter referred to as XC polymers.

Some of the many metal salts usable for cross-linking XC polymers and thus increasing the viscosity of XC polymer water fluids are aluminum sulfate [$Al_2(SO_4)_3$], ferric sulfate [$Fe_2(SO_4)_3$], and chromium chloride [$CrCl_3$]. Cross-linking is accomplished by mixing a water solution of the appropriate metal salt with the XC polymer solution at ambient temperature. It may be necessary to adjust the pH of the solution using either hydrochloric acid and/or a water solution of sodium hydroxide. Cross-linking occurs within a range of about pH 4 to pH 10 when aluminum sulfate is used, pH 2 to pH 13 when ferric sulfate is used and pH 5 to pH 13 when chromium chloride is used. Most divalent ions require a pH 10 or above for cross-linking. Divalent ions may produce cross-linked gels under neutral or even acidic conditions. Based on the complete mixed composition, the water comprises from about 95 to about 99.5 weight percent, the XC polymer from about 0.5 to about 5 weight percent and the multivalent metal salt from about 0.01 to about 0.1 weight percent. Particulates may optionally be included.

Water base Bingham plastic fluids usable for removing debris from pipelines can also be made using other water soluble polymers, with or without particulates. For example, a mixture containing about 1% by weight of water soluble polymer such as guar gum, carboxymethylcellulose, or polyacrylamide (as exemplified by Hercules Reten 423) and about 6% by weight bentonite clay (as exemplified by Milwhite Aquagel) is a Bingham plastic fluid usable for removing debris from pipelines.

EXAMPLES

About 155 gallons of a mineral oil base plastic fluid described in Table 4 was injected into a 2.52 mile long 6-inch diameter pipeline containing sand, iron rust, asphalt particles, other debris, and water distributed throughout its length. Test data presented in Tables 5 and 6 and FIG. 2 clearly demonstrate the unique action of Bingham plastic fluids in removing the loose and loosely adhering debris and distributing it throughout the fluid slug.

Figure 3:
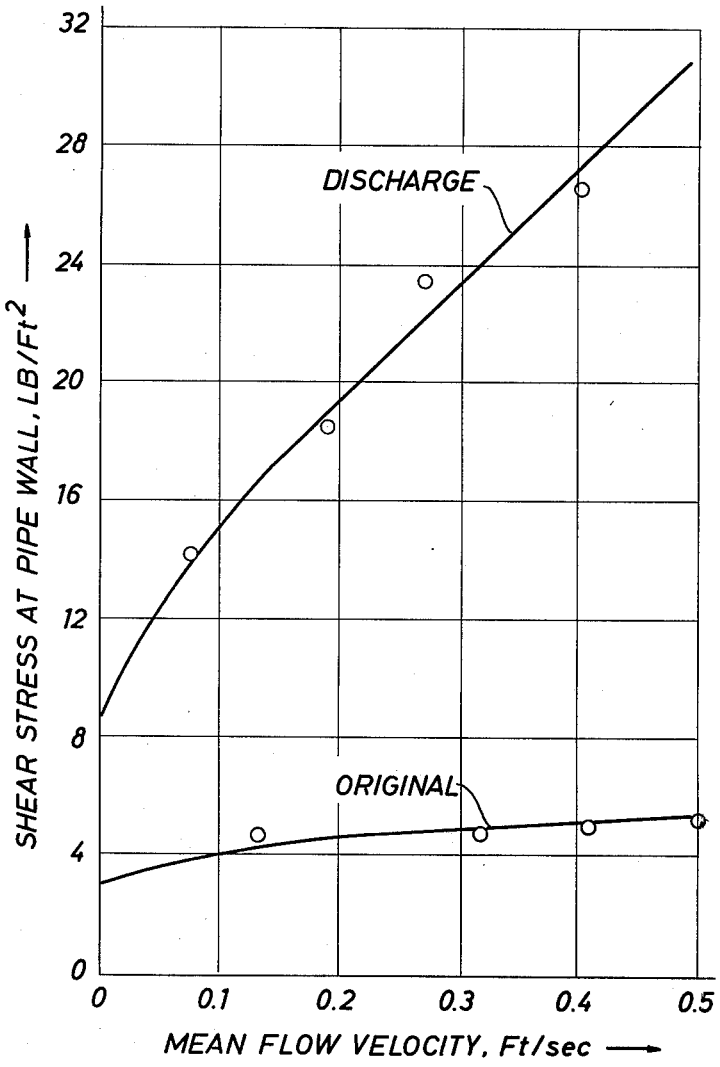
FIG. 3 shows the effect of solids incorporated from a pipe on plastic slug rheology.
Figure 4:
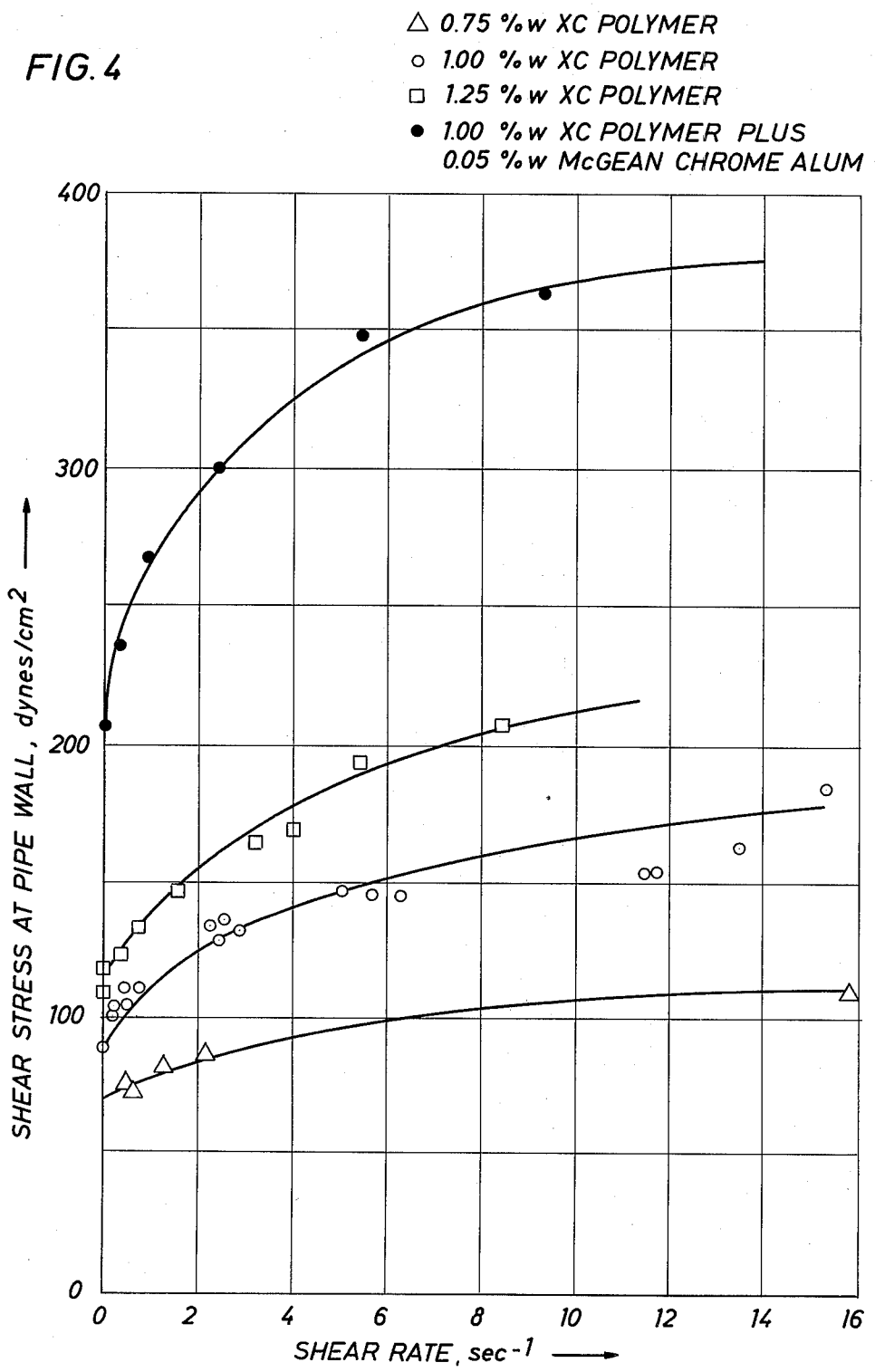
FIG. 4 shows flow characteristics of the Kelzan XC®polymer (see Table 7) with fresh water fluids at 6° C. in a 8 mm I.D. tube.

The variation in rheological properties obtainable by varying the components in a water base plastic fluid are shown in FIG. 3 and Table 7. These gels can be compounded using existing laboratory and/or field mixing equipment.

Laboratory tests in a transparent 2-inch diameter Plexiglass pipe containing colored sand and gravel clearly show that a 1% by weight XC polymer-water fluid followed by a 2-inch sphere picked up the sand and gravel from the bottom of the pipe, forced it into the central plug flow portion, and thus transported it to the front and distributed the sand and gravel throughout the fluid slug as the fluid and sphere moved through the pipeline.

TABLE 1

Typical Properties of Materials Blended to Make Bingham Plastic Cleaning Fluids

| | Dubbs No. 9 Flashed Residue | OP-2 Light Gas Oil (APO 100) |
|---|---|---|
| Gravity, °API @ 60 | 9–10 | 12.2–17.3 |
| Viscosity, SSU @ °F. | | |
| 100 | — | 34–37 |
| 210 | 500 | — |
| Flash PMCC, °F. | — | 200 min. |
| Pour Point, °F. | +60 | −25 |
| Aromatics, % w | 75 | 93–98 |
| Water, % w | — | 1 |
| Distillation, °F. | | |
| IBP | | 425–450 |
| 10 | | 465 |
| 50 | | 495 |
| 90 | | 570 |
| EP | | 600–660 |

TABLE 2

Typical Properties of Solids Used to Make Bingham Plastic Cleaning Fluids

| | % w |
|---|---|
| Coal | |
| Sulphur | <1 |
| Moisture | 1–2 |
| Sieve Analysis | |
| +100 US Mesh | — |
| +200 US Mesh | 8–9 |
| +325 US Mesh | 33–38 |
| −325 US Mesh | 55–59 |
| Magcobar VG69 | |
| Moisture | 3–4 |
| Organic[1] | 42 |

[1]VG 69 is a quaternary exchanged bentonite containing 42% w organic. The quaternary alkyl groups contain 15–16 carbon atoms.

TABLE 3

Bingham Plastic Fluids - Laboratory Data Obtained Prior to Field Tests with Some Components

| Component | Blend 1 | Blend 2 | Blend 3 | Blend 4 | Blend 5 | Blend 6 | Blend 7 | Blend 9 |
|---|---|---|---|---|---|---|---|---|
| | Grams Per 100 Grams of Blend | | | | | | | |
| Dubbs No. 9 Residue[1] | 19.58 | 19.35 | 18.12 | 30.85 | 29.87 | 29.52 | 29.45 | 64.3 |
| O.P. 2 Light Gas Oil[1] | 42.95 | 42.45 | 39.75 | 30.85 | 29.87 | 29.52 | 29.45 | 27.2 |
| −100 Mesh Alabama Coal[2] | 30.75 | 30.39 | 34.82 | 31.67 | 32.84 | 32.99 | 32.89 | 0.0 |
| Magcobar VG69[2] | 6.72 | 7.80 | 7.30 | 6.63 | 7.41 | 7.97 | 8.23 | 18.5 |
| | Shear Stress in lbs/ft$^2$ at Flow Velocity in ft/sec × 100 | | | | | | | |
| | 3.2/1.6 | 5.1/2.1 | 7.6/2.1 | 3.8/2.7 | 6.8/2.6 | 6.9/2.7 | 8.8/2.6 | .0/1.4 |
| | 2.5/2.2 | 4.9/2.5 | 7.3/3.2 | 4.0/4.0 | 7.3/4.0 | 7.7/4.1 | 9.2/4.0 | 8.7/2.5 |
| | 2.0/2.6 | | 6.4/6.5 | 4.3/5.3 | 7.8/5.2 | 7.9/5.3 | 9.6/5.1 | 11.3/3.8 |
| | 1.7/2.9 | 4.3/3.8 | | | | 7.7/3.8 | 10.4/5.7 | 11.5/4.9 |
| | | 4.3/3.8 | | | | 8.2/5.1 | | |

[1]See Table 1
[2]See Table 2

TABLE 4

Composition of Plastic Fluid Used to Remove Sand and Debris from a 6-Inch Pipeline[1]

| Component | Composition Pound per Pound of Blend |
|---|---|
| Dubbs No. 9 Residue[2] | 36.13 |
| O.P. 2 Light Gas Oil[2] | 22.17 |
| −100 Mesh Alabama Coal[3] | 33.08 |
| Magcobar VG69[3] | 8.62 |
| | 100.00 |

Figure 2:
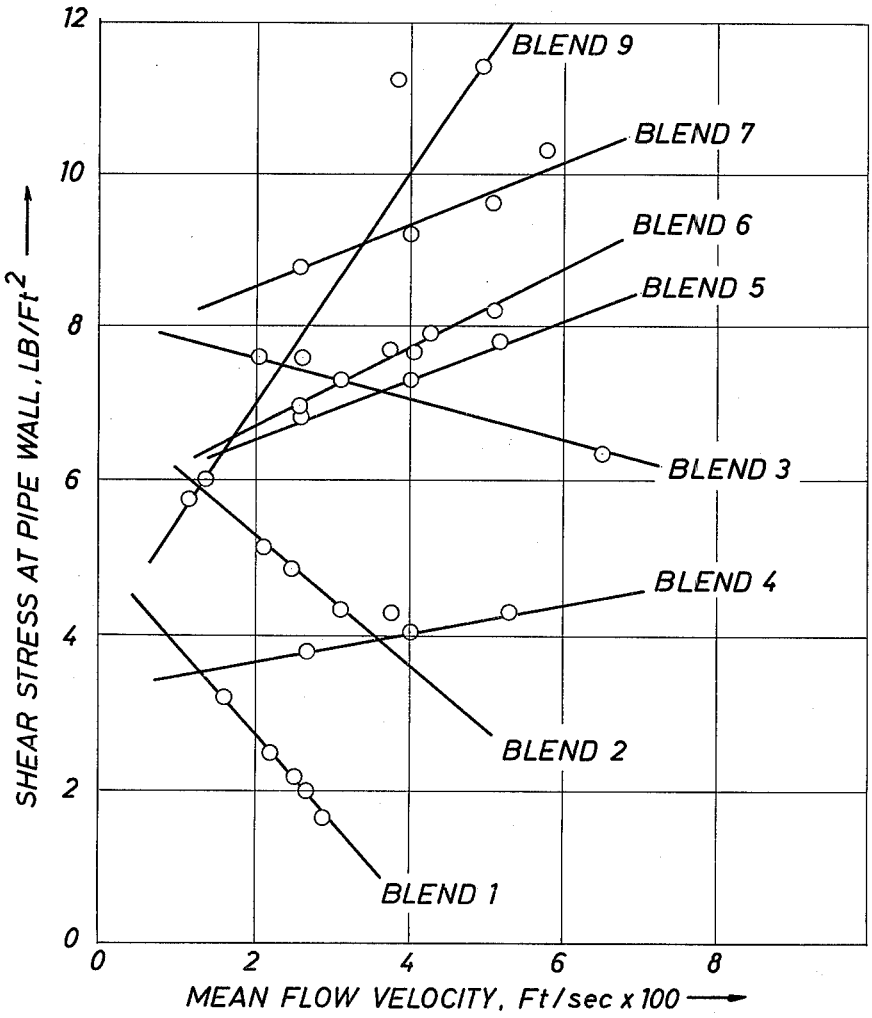
FIG. 2 shows flow characteristics of plastic fluid blends of various compositions (see Table 3) in 2.05-inch diameter pipe tests.

[1]See Rheological Properties - FIG. 2
[2]See Table 1
[3]See Table 2

TABLE 5

Effect of Loose Solids and Water in Pipelines on a Fluid Rheology and Composition - 2 Inch Pipe Data

| Test No. | Temp., °F. | Velocity, ft/sec | Pressure Drop, lbs/in$^2$ | Plug Length, ft | Wall Shear Stress, lbs/ft$^2$ |
|---|---|---|---|---|---|
| 1 | Gel Plug No. 1 - First of Batch from Mixer | | | | |
| 1 | 70 | 0.013 | 1.05 | 1.34 | 4.8 |
| 2 | 70 | 0.032 | 1.07 | 1.34 | 4.9 |
| 3 | 70 | 0.041 | 1.12 | 1.34 | 5.1 |
| 4 | 70 | 0.049 | 1.17 | 1.34 | 5.4 |
| | Gel Plug No. 1 Center of Plug Length at Discharge from 2.52 Mile Long 6-Inch Pipeline Containing Debris | | | | |
| 1 | 70 | 0.008 | 2.99 | 1.29 | 14.3 |
| 2 | 70 | 0.019 | 3.87 | 1.29 | 18.5 |
| 3 | 70 | 0.027 | 4.92 | 1.29 | 23.5 |
| 4 | 70 | 0.040 | 5.57 | 1.29 | 26.6 |

| | Gel Plug Composition | | | | | |
|---|---|---|---|---|---|---|
| | Solids | | Oil | | Water | |
| | % w | % v | % w | % v | % w | % v |
| Original | 42 | 33 | 56 | 64 | 2 | 3 |
| Discharge | 61 | 46 | 19 | 27 | 20 | 27 |

TABLE 6

Solids Removed from a 6-Inch 2.52-Mile Land Pipeline by 155 Gallons of a Plastic Fluid

| Location of Sample in Slug: | First 1% | Center | Last 10% |
|---|---|---|---|
| Solids > 0.15 mm Entering, % w | 0 | 0 | 0 |
| Solids > 0.15 mm Leaving, % w | 14.0 | 14.0 | 14.7 |
| Total Solids Removed from Pipeline, % w | 19.0 | 19.0 | 26.0 |

NOTE:
Total solids removed from pipe = 285 pounds
Total solids removed from pipe = 2.8 ft$^3$
Total solids removed from pipe = 14 *feet long plug*

TABLE 7

Settling Rate of Particles of Materials In Water - XC Polymer Plastic Fluids

| | Settling Rate, Centimeter Per Hour | | | |
|---|---|---|---|---|
| [1]XC Polymer, % w | 0.75 | 1.00 | 1.25 | 1.00 |
| [2]McGean Chrome | 0.00 | 0.00 | 0.00 | 0.05 |
| Alum, % w | | | | |
| Particle | | | | |
| Silicate, 2.3 sp. g. | | | | |
| 1 mm | 0.3 | 0.01 | <0.01 | <0.01 |
| 10 mm | >1000 | 90 | — | <0.01 |
| Aluminum, 2.7 sp. gr. | | | | |
| 6 mm | 22 | 0.3 | 0.06 | <0.01 |
| Stainless Steel, 7.7 sp. g. | | | | |
| 8 mm | >1000 | 150 | 34 | 3 |

[1]Xanthan gum, a high molecular weight linear natural polysaccharide produced by themicro-organism Xanthomonas Compestris
[2]Potassium Chromium Sulfate

I claim as my invention:

1. A method for removing fluid and/or particulate debris from a pipeline with a Bingham plastic plug comprising, inserting the plug into the pipeline, moving the plug through the pipeline by a circulating motion essentially generating a closed toroid of Bingham plastic, the wall of the toroid adjacent the wall of the pipeline remaining relatively stationary and the center of the toroid moving in the direction of motion of the plug, and collecting the fluid and/or particulate debris with the plug.

2. The method of claim 1, wherein the plug is pushed with a scraper.

3. The method of claim 2, wherein the scraper is pushed with a gas.

4. The method of claim 2, wherein the scraper is pushed with a liquid.

5. The method of claim 1, wherein the debris comprises at least one of rust, silt, sand and weld slag.

6. The method of claim 1, wherein the plug comprises a mineral oil, an organo-modified smectite and a particulate filler.

7. The method of claim 6, wherein the particulate filler is powdered coal.

8. The method of claim 1, wherein the plug comprises a mineral oil and an organo-modified smectite.

9. The method of claim 1, wherein the plug comprises water and xanthan gum.

10. The method of claim 9, wherein the xanthan gum is cross-linked with a multivalent metal.

11. The method of claim 2, wherein the scraper is a sphere.

12. The method of claim 2, wherein the scraper is a flat disc.

13. The method of claim 2, wherein the scraper is concave facing toward the plug.

14. The method of claim 2, wherein the scraper is made of polyurethane.

15. The method of claim 1, wherein the plug is preceded by a scraper and particulate matter adhering to the inside of the pipeline is loosened from the pipeline by the preceding scraper.

16. The method of claim 1, wherein the plug is preceded by a scraper and at least part of the fluid in the pipeline is excluded from contact with the plug.

17. The method of claim 1, wherein the fluid is water and the plug comprises water and a xanthan gum.

18. The method of claim 17, wherein the xanthan gum is cross-linked with a multivalent metal.

19. The method of claim 1, wherein the fluid is a hydrocarbon and the plug comprises a mineral oil and an organo-modified smectite.

20. The method of claim 19, wherein the plug includes a particulate filler.

21. The method of claim 1, wherein the length of the plug is adjusted so that the debris acquired by the plug from the pipeline will be less than about 25% v of the plug.

* * * * *